US005333998A

United States Patent [19]

Yoshida et al.

[11] Patent Number: 5,333,998

[45] Date of Patent: Aug. 2, 1994

[54] PINTLE FIXING CONSTRUCTION FOR RADIAL PLUNGER PUMP

[75] Inventors: Hiroshi Yoshida; Mitsuru Kakuda, both of Saitama, Japan

[73] Assignee: Jidosha Kiki Co., Ltd., Tokyo, Japan

[21] Appl. No.: 28,842

[22] Filed: Mar. 10, 1993

[30] Foreign Application Priority Data

Apr. 27, 1992 [JP] Japan ..... 4-035151[U]

[51] Int. Cl.[5] ..... F04B 1/04

[52] U.S. Cl. ..... 417/273; 91/491; 92/58; 92/72

[58] Field of Search ..... 417/273, 462; 91/491; 92/58, 72

[56] References Cited

U.S. PATENT DOCUMENTS

| | | | |
|---|---|---|---|
| 2,599,609 | 6/1952 | Carey | 92/58 |
| 2,653,542 | 9/1953 | Horton | 92/58 |
| 2,972,961 | 2/1961 | Clark | 92/58 |
| 3,063,380 | 11/1962 | Strickland | 92/58 |
| 3,949,647 | 4/1976 | Martin | 91/491 |
| 4,041,844 | 8/1977 | Steiger | 92/58 |
| 4,776,768 | 10/1988 | Kondoh et al. | 417/273 |
| 4,927,338 | 5/1990 | Ito et al. | 417/462 |

FOREIGN PATENT DOCUMENTS 61-1876 1/1986 Japan .

*Primary Examiner*—Richard A. Bertsch
*Assistant Examiner*—Peter Korytnyk
*Attorney, Agent, or Firm*—Flynn, Thiel, Boutell & Tanis

[57] ABSTRACT

The ease of assembly of a radial plunger pump is improved while preventing an external leakage of liquid. A pump housing 2 in the form of a cylinder having a closed bottom contains a pintle 4 therein, which is secured to the bottom of the pump housing 2 by a bolt 6. A rotor 8 is rotatably fitted around the pintle. The rotor is formed with a plurality of radially extending cylinder bores 8*a*, in each of which a plunger 10 is slidably disposed. A guide ring 16 is disposed around the rotor. A motor 20 is fastened to and secured to the opening of the pump housing, and includes a drive shaft which is connected to the rotor to drive it for rotation. By allowing parts to be assembled into the pump housing in one direction, the ease of assembly is improved while preventing a liquid leakage.

9 Claims, 6 Drawing Sheets

PINTLE FIXING CONSTRUCTION FOR RADIAL PLUNGER PUMP

BACKGROUND OF THE INVENTION

The invention relates to a radial plunger pump, and in particular, to a construction for fixing a pintle to a pump housing.

A radial plunger pump generally comprises a pintle in which a suction and a discharge passage are formed and which is secured to a pump housing, while a rotor having a plurality of radially extending cylinder bores formed therein is rotatably fitted around the pintle, with a plunger being slidably disposed in each of the cylinder bores. A guide ring is disposed within the pump housing in eccentric relationship with the center of rotation of the rotor so that the rotation of the rotor within the guide ring causes a reciprocating motion of the plungers to thereby increase or decrease the volume of a pump chamber defined inside the respective plunger to provide a suction and discharge of a working oil.

In a conventional radial plunger pump, the pintle is secured to a lateral side of the pump housing from the outside, with its inner end being inserted through an opening formed in the lateral side of the housing so that the rotor may fit around the inserted portion of the pintle (see Japanese Laid-Open Patent Application No. 1,876/1986).

In such a conventional construction for fixing the pintle, the pintle which is secured to the outside of the pump housing must be assembled in the opposite direction from the rotor and the guide ring which are received within the pump housing, thus presenting an inefficiency in the assembling operation. This also involved the likelihood that the pintle may be assembled in a wrong position, whereby the suction groove and the discharge groove formed in the pintle may be located in interchanged manner, preventing a pumping action. Such a wrong assembly could be detected only upon inspection which takes place after the completion of the assembly. In addition, since the pintle is secured to the external surface of the pump housing with a seal member interposed therebetween, an oil leakage is likely to occur, thus presenting a problem of reliability.

SUMMARY OF THE INVENTION

Accordingly, it is an object of the invention to provide a pintle fixing construction for a radial plunger pump which can be easily assembled and which exhibits a high reliability, free from the likelihood of causing an external leakage.

Such object is accomplished by providing a pintle having a suction and a discharge passage formed internally therein and around which a rotor is rotatably fitted, the pintle being received within a receiving opening formed in a pump housing and secured to the bottom thereof.

It is a second object of the invention to provide a pintle fixing construction for a radial plunger pump which is free from the likelihood of a wrong assembly when fixing the pintle to the housing.

Such object is accomplished by utilizing a plurality of fixing bolts which are arranged in a non-symmetrical manner or which have different sizes, or by utilizing positioning means which positions the pintle relative to the pump housing.

DESCRIPTION OF EMBODIMENTS

Figure 1:
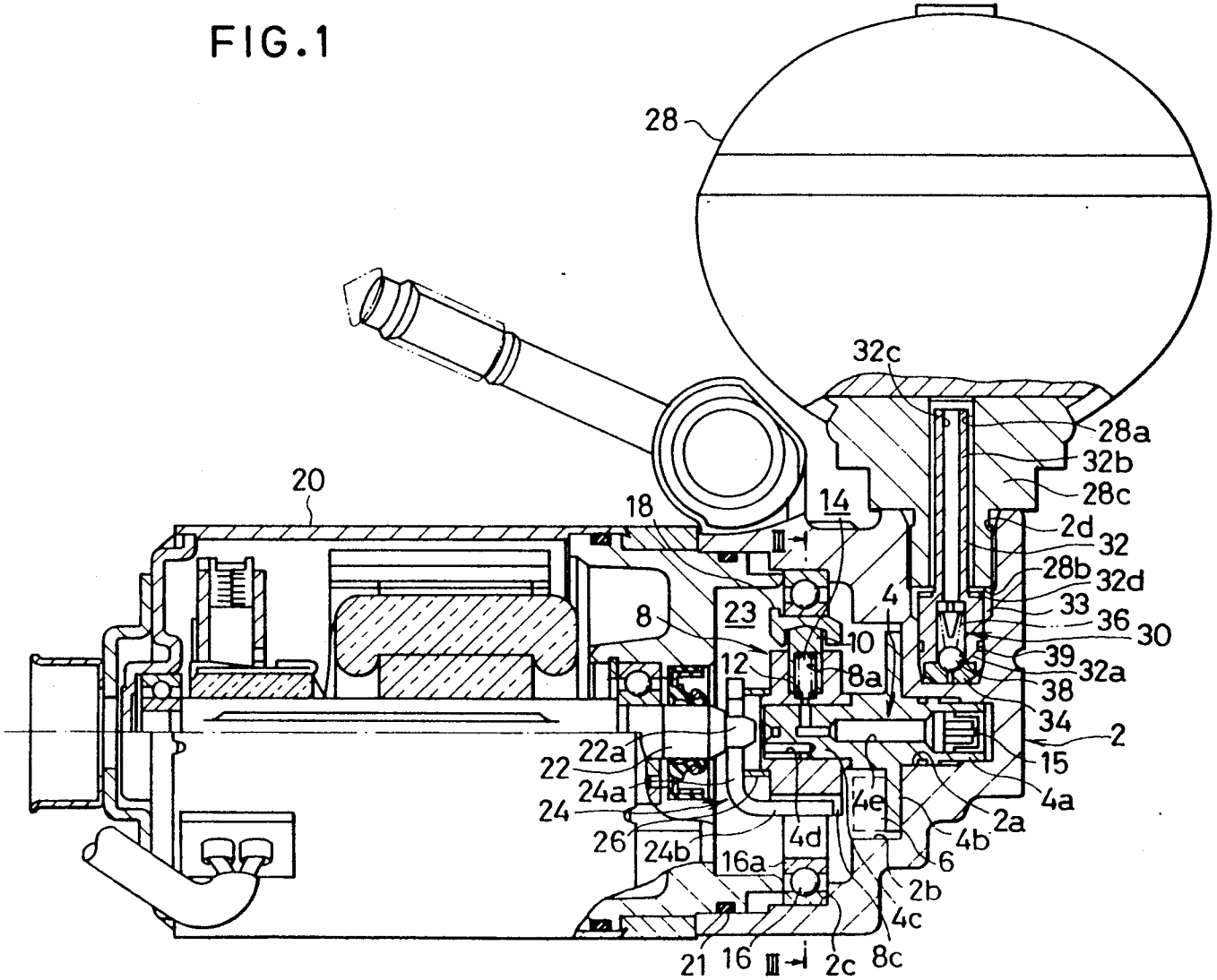
FIG. 1 is a section, taken along the line I—I shown in FIG. 2, of a radial plunger pump according to one embodiment of the invention.
Figure 4:
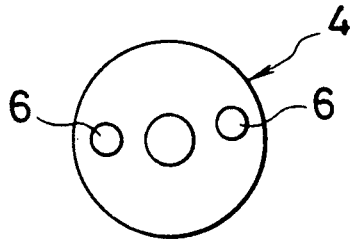
FIG. 4 schematically shows one manner of fixing a pintle to a pump housing.

Referring to the drawings, the invention will now be described with reference to several embodiments thereof. Referring to FIG. 1, a pump housing 2 is in the form of a cylinder having a closed end, and includes a plurality of steps formed therein. Toward its bottom or to the right end thereof, as viewed in FIG. 1, the pump housing 2 includes a bore 2*a* of a reduced diameter, in which one end 4*a* of a pintle 4 is inserted. Intermediates its length, the pintle 4 is formed with a flange 4*b*, which is secured to the bottom surface of a bore 2*b* of an intermediate diameter formed in the pump housing 2 by means of a plurality of bolts 6. The other end 4*c* of the pintle 4 projects into a bore 2*c* of an increased diameter formed in the pump housing 2, with a rotor rotatably fitted around the projecting end 4*c*. In the present embodiment, two bolts 6 are used to fix the pintle 4 to the housing 2, and are circumferentially displaced from symmetrical positions, as illustrated in FIG. 4.

The rotor 8 is formed with a plurality (which is three in the present embodiment) of cylinder bores 8*a*, which are equally spaced apart in a circumferential direction and which extend radially. A plunger 10 having an end which is in the form of part of a spherical surface is slidably fitted in each cylinder bore 8*a*, and is urged radially outward by a spring 12 disposed in a space located inward of the plunger. An internal space defined between the bottom of the plunger 10 and the cylinder bore 8*a* constitutes a pump chamber 14.

The pintle 4 is internally formed with a suction passage 4*d* and a discharge passage 4*e*, both of which extend axially. In a region which is fitted inside the rotor 8, the outer peripheral surface of the pintle 4 is formed with a suction groove 4*f* and a discharge groove 4*g* at diametrically opposite positions which extend through substantially 90° as viewed in terms of the angle of rotation of the rotor 8. The suction passage 4*d* and the discharge passage 4*e* communicate with the suction groove 4*f* and the discharge groove 4*g*, respectively. A communication opening 8*b* is formed in the bottom of the cylinder bore 8*a* in the rotor 8, and operates to connect the pump chamber 4 with the suction groove 4f and the discharge groove 4g formed in the pintle 4 as the rotor 8 rotates. At its downstream end, the discharge passage 4e formed in the pintle 4 has an increased diameter, in which a filter 15 is received. A working oil which is discharged from the pump chamber 14 passes through the filter 15, thus removing abrasion products such as powder which may be developed as a result of a sliding movement between the rotor 8 and the pintle 4 and between the rotor 8 and the plunger 10.

Figure 3:
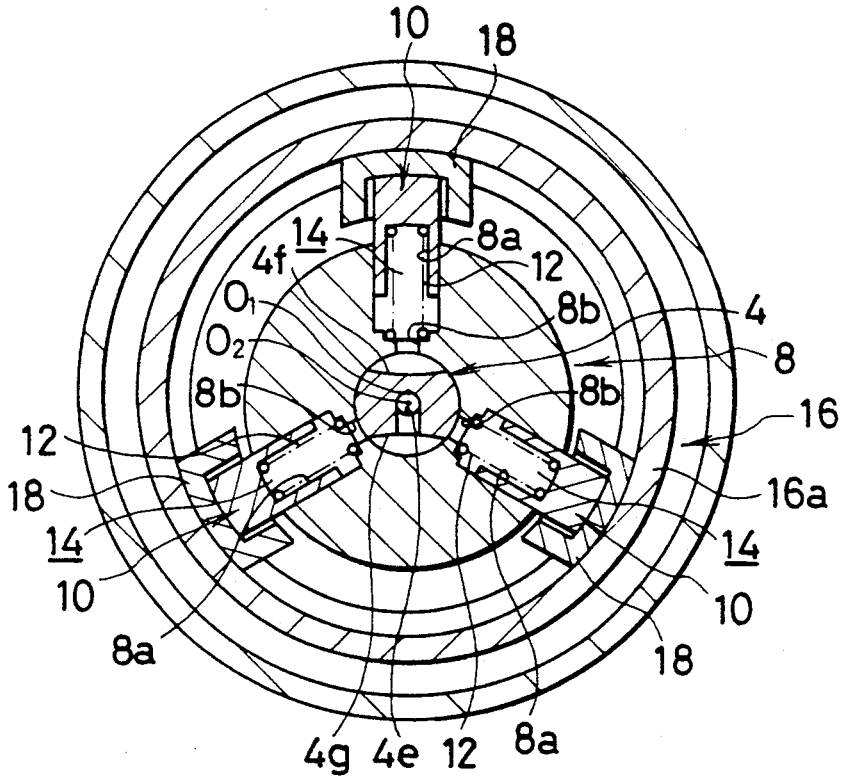
FIG. 3 is a cross section, taken along the line III—III shown in FIG. 1.

A ball bearing (or also referred to as a guide ring) 16 is press fit in the bore 2c of an increased diameter in the pump housing 2, and has a center 01 which is eccentrically located with respect to the center of rotation 02 of the rotor 8 (see FIG. 3). On the other hand, a shoe 18 which is substantially in the form of a cap is fitted over the outer end of each plunger 10, and the plunger 10 which is urged by the spring 12 resiliently bears against the ball bearing 16 through the interposed shoe 18, thus rotating with the inner race 16a of the ball bearing 16. The outer surface of the shoe 18 has an arcuate profile which substantially conforms to the curvature of the inner surface of the inner race 16a of the ball bearing 16 while the inner surface of the shoe 18 is formed as a spherical recess which substantially conforms to the configuration of the spherical surface of the outer end of the plunger 10.

At its end remote from the closed end, the pump housing 2 has an opening in which a motor 20 is fixedly mounted. The end of the motor 20 which is located adjacent to the pump housing 2 is tubular so that it may be fitted into the opening of the pump housing 2. An O-ring 21 is fitted between the inner surface of the pump housing 2 at its opening and the tubular outer surface of the motor 20 to maintain a liquid tightness, thus defining the liquid chamber 23 therein. The motor 20 has an output rod 22 having a prism-shaped free end 22a, which is fitted in a rectangular opening formed in an upright portion 24a of a joint 24 which is substantially L-shaped in section. The L-shaped joint 24 also includes a horizontal portion 24b, which is engaged within a notch 8c formed in the rotor 8 so that the rotation from the output rod 22 of the motor 20 may be transmitted through the joint 24 to rotate the rotor 8. A coiled spring 26 is disposed between the upright portion 24a of the joint 24 and the lateral side of the rotor 8 to urge the rotor 8 toward the pintle 4, thus preventing an axial displacement of the rotor 8.

An accumulator 28 is fixedly mounted on top of the pump housing 2 at its end remote from the motor 20 or on its right-hand end, as viewed in FIG. 1. The pump housing 2 is formed with a mounting hole 2d, in which a check valve 30 is inserted. The accumulator 28 includes an oil port 28c which is threadably engaged with the mounting hole 2d toward its opening. The check valve 30 comprises a valve body 32 in the form of a stepped cylinder, a valve seat 34 caulked to the end of the body 32 which is located toward a portion 32a thereof which has an increased diameter, and a ball valve 38 received within the portion 32a and urged by a spring 36 to be seated upon the valve seat 34. It will be noted that the portion 32a of the valve body 32 which has an increased diameter is inserted into the mounting hole 2d in the pump housing 2 until it reaches the bottom thereof. An O-ring 39 is fitted around the portion 32a to maintain a liquid tightness. The valve body 32 also includes a portion 32b of a reduced diameter which is in the form of an elongate cylinder and which is inserted into a circular bore 28a formed in the oil port 28c of the accumulator 28. The body portion 32b has an internal passage 32c formed therein, which opens into an accumulation chamber of the accumulator 28. A clearance is formed between the outer peripheral surface of the body portion 32b and the inner peripheral surface of the circular bore 28a in the accumulator 28, and a clearance is also formed between a step 32d formed between the body portions 32a and 32b of different diameters and an end face 28b on the oil port 28c which is threadably engaged within the housing 2.

Figure 2:
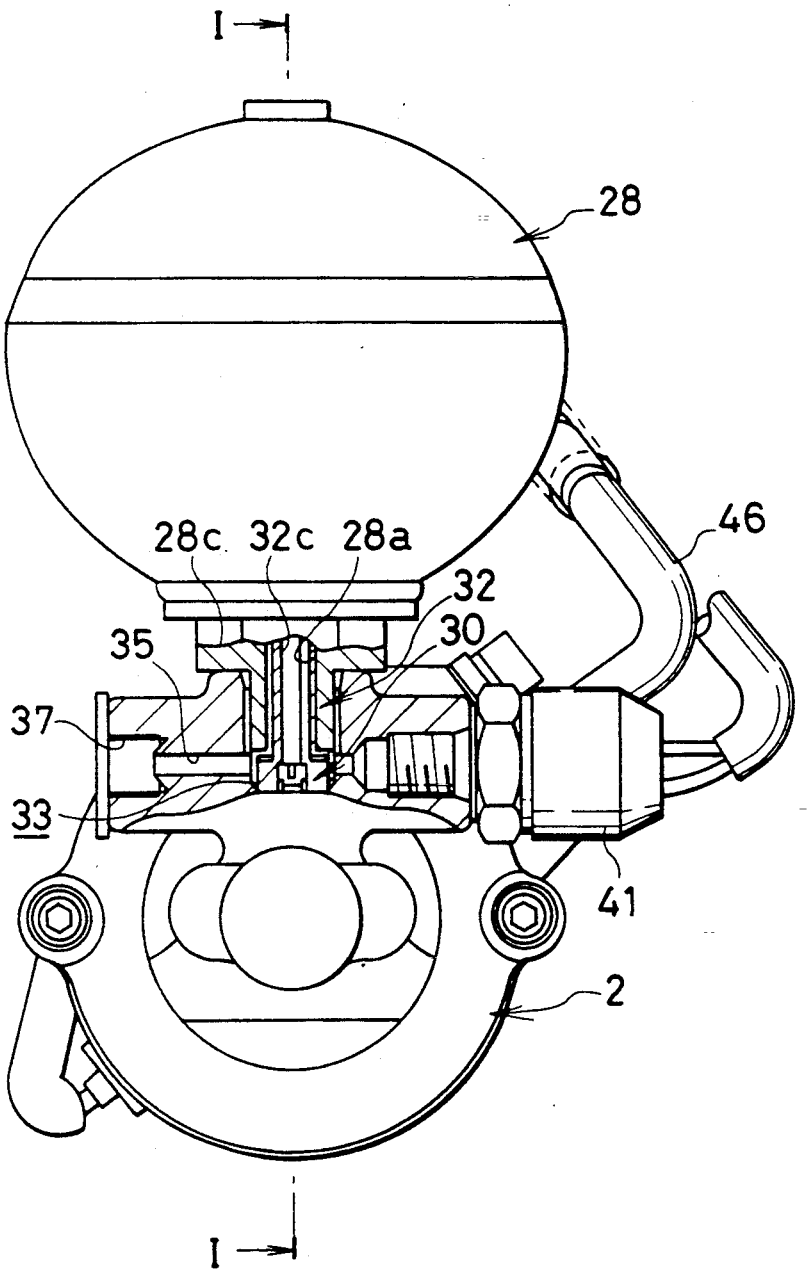
FIG. 2 is a side elevation, partly in section, of the radial plunger pump.

It will be noted that the mounting hole 2d formed in the pump housing 2 includes a portion in which the body portion 32a is inserted and another portion in which the accumulator 28 is threadably engaged, and that these portions have different internal diameters. A space 33 is defined around the body portion 32a adjacent to the step between these portions of different internal diameters. The housing 2 is formed with a discharge passage 35 and a discharge port 37 which connect the space 33 located around the body portion 32a to the exterior (see FIG. 2). The space 33 is also connected to a pressure switch 41. The pump housing 2 is formed with a suction port 40 and a suction passage 42 as shown in FIG. 10, whereby a working oil which is withdrawn from a reservoir, not shown, may pass through the suction port 40 and the suction passage 42 to enter the liquid chamber 23 defined between the pump housing 2 and the motor 20 and thence introduced into the pump chamber 14 within the cylinder bore 8a through the suction passage 4d and the suction groove 4f formed in the pintle 4.

Figure 10:
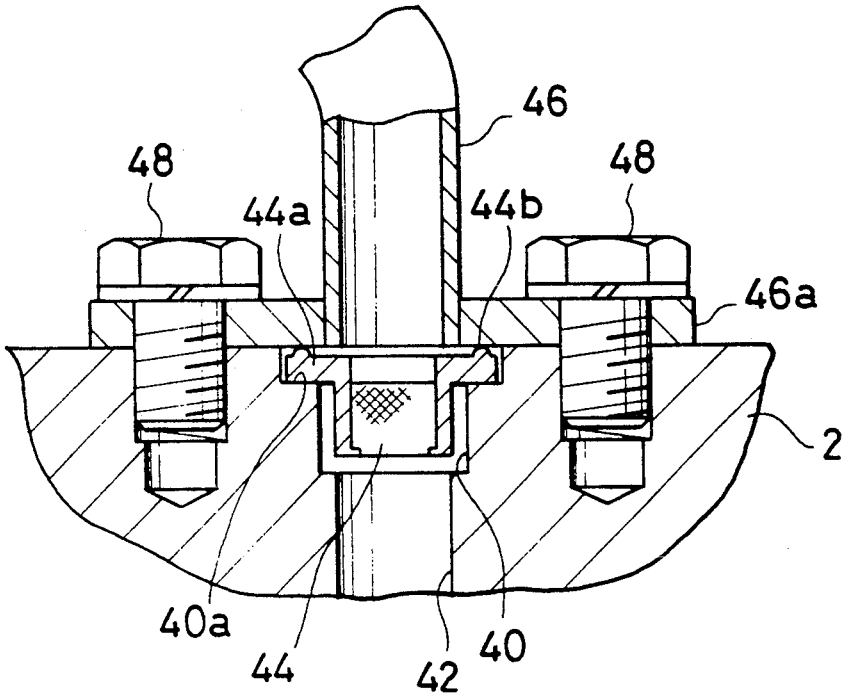
FIG. 10 is a cross section through a suction port of the radial plunger pump.
Figure 11:
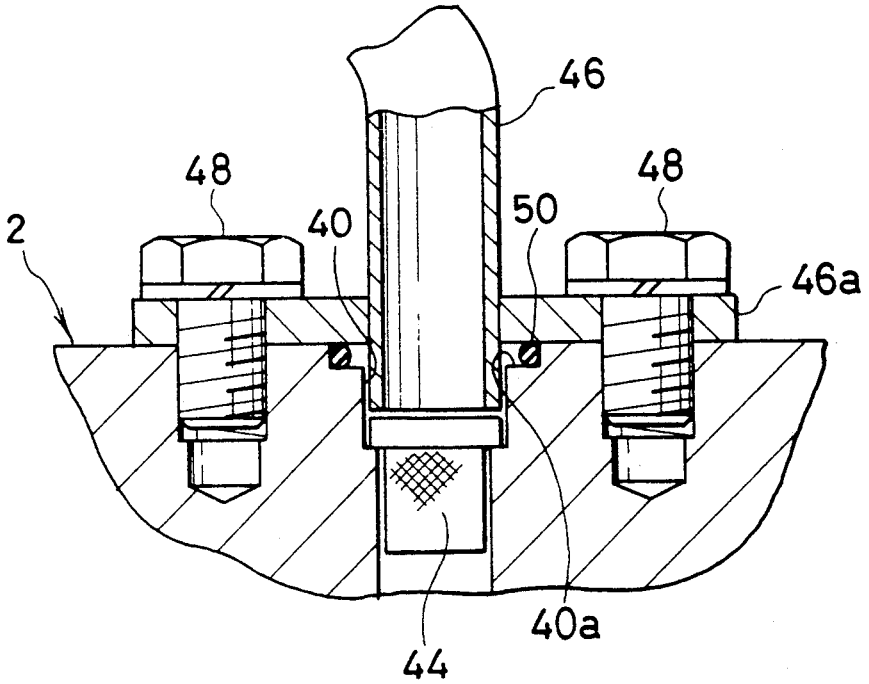
FIG.11 PRIOR ART
FIG. 11 is a cross section, similar to FIG. 10, illustrating a suction port of a conventional radial plunger pump.

Referring to FIG. 10, the construction of the suction port in the housing 2 will be described in more detail. The opening of the suction port 40 is formed with an annular recess 40a, in which a filter 44 having a frame formed of resin material is fitted, with its flange 44a fitting in the annular recess 40a. On its outer surface, the flange 44a of the filter 44 is formed with an annular projection 44b, which abuts against the inner surface of a mounting plate 46a to be held in close contact to provide a sealing function. The mounting plate 46a is integral with a hose connector 46, to which a hose extending from a reservoir is connected, and is disposed to cover the suction port 40 containing the filter 44 by being secured to the housing by bolts 48. In a conventional construction of the suction port as shown in FIG. 11, the filter 44 is inserted deep into the suction port 40, while an O-ring 50 is mounted in the annular recess 40a which is formed around the opening of the suction port 40 to maintain the liquid tightness of the pump housing 2. By contrast, the annular projection 44b on the flange 44a of the filter 44 is held in close contact with the mounting plate 46a of the hose connector 46 to provide a sealing function in the present embodiment, thus dispensing with the need for an O-ring and thus reducing the number of parts by one without degrading the sealing function.

The operation of the radial plunger pump constructed in the manner mentioned above will now be described. When the rotor 8 rotates in response to a drive from the output rod 22 of the motor 20, the eccentric relationship between the center of rotation 02 of the rotor 8 and the center 01 of the ball bearing 26 causes a radial reciprocating motion of the plungers 10 within the cylinder bores 8a to increase or decrease the volume of the pump chambers 14 as the rotor 8 rotates.

During a suction stroke when the plunger 10 moves outward (shown in the top portion of FIG. 3), the working oil from a reservoir, not shown, passes through the suction port 40 and the suction passage 42 formed in the pump housing 2 to enter the liquid chamber 23, and thence withdrawn into the pump chamber 14 located toward the bottom of the cylinder bore 8*a* through the suction passage 4*d* and the suction groove 4*f* formed in the pintle 4 and through the communication opening 8*b* formed in the rotor 8.

When the plunger 10 experiences a discharge stroke, shown in the lower portion of FIG. 3, as a result of rotation of the rotor 8, the plunger 10 will be driven radially inward by the ball bearing 26 which is disposed eccentrically with respect to the rotor 8, thus decreasing the volume in the pump chamber 14. The working oil which is discharged from the pump chamber 14 passes through the communication opening 8*b* formed in the bottom of the cylinder bore 8*a*, through the discharge groove 4*g* and the discharge passage 4*e* formed in the pintle 4 and through the filter 15 which is disposed downstream of the discharge passage to be fed to the check valve 30. As it forces open the ball valve 38 of the check valve 30, the working oil flows past it, and is introduced into the accumulation chamber of the accumulator 28 through the internal passage 32*c* inside the tubular portion 32*b* of a reduced diameter of the valve body 32. Upon entering the accumulator 28, the working oil is discharged through the clearance defined between the outer surface of the reduced diameter portion 32*b* of the valve body 32 and the inner surface of the bore 28*a* in the accumulator 28, through the space 33 around the valve body 32*a*, and through the discharge passage 35 and the discharge port 37 formed in the pump housing 2 to be fed to a hydraulic instrument such as a liquid pressure brake booster, not shown.

In the radial plunger pump of the embodiment, the pintle 4 is received within the pump housing 2 in the form of a cylinder having a closed end, so that during the assembly, the pintle 4, the ball bearing 16, the rotor 8 and the motor 20 may be sequentially assembled, beginning with the bottom side of the pump housing 2, or in a unilaterally defined direction, which improves the ease of assembly as compared with a conventional practice in which the pintle is assembled from the opposite direction. Unlike an arrangement in which the pintle is secured to the outside with its one end extending into the pump housing 2, there is no likelihood of causing an external leakage while allowing a reduction in the size of the overall pump.

Figure 5:
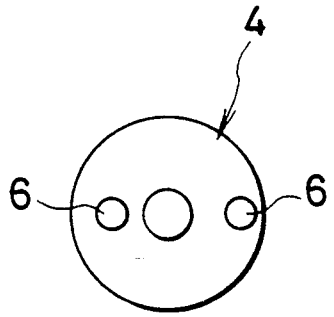
FIG. 5 schematically shows another manner of fixing the pintle to the pump housing.
Figure 6:
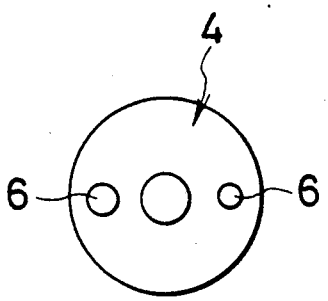
FIG. 6 schematically illustrates a further manner of fixing the pintle to the pump housing.
Figure 7:
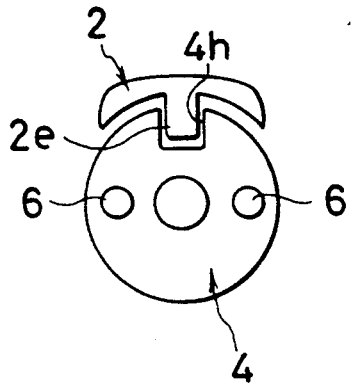
FIG. 7 schematically shows still another manner of fixing the pintle to the pump housing.
Figure 8:
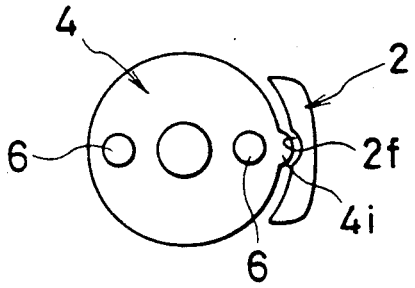
FIG. 8 schematically illustrates a still further manner of fixing the pintle to the pump housing.
Figure 9:
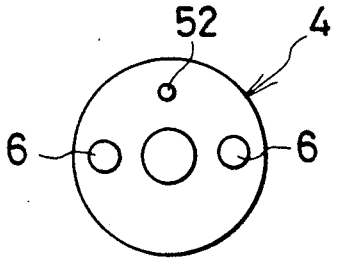
FIG. 9 schematically illustrates yet another manner of fixing the pintle to the pump housing.

In the described embodiment, two bolts 6 which are used to secure the flange 4*b* of the pintle 4 to the housing 2 are circumferentially displaced from their symmetrical position, as illustrated in FIG. 4. In the conventional arrangement, such bolts have been located at symmetrical positions, causing a likelihood that the pintle may be assembled in a wrong position or 180° out of phase position from the correct or intended position. If the pintle 4 is assembled in such a wrong position, there results a problem that the intended pumping action cannot be achieved. By contrast, the locations of the bolts 6 are displaced in accordance with the invention, thus effectively preventing a wrong assembly of the pintle 4. It will be appreciated that the arrangement of the bolts 6 which are used to secure the pintle 4 is not limited to that shown in FIG. 4, but that the two bolts may be disposed at radially offset positions as illustrated in FIG. 5, or may be located at symmetrical positions while utilizing different sizes for two bolts (see FIG. 6). Alternatively, a recess 4*h* may be formed in the periphery of the pintle 4 while the pump housing 2 may be provided with a projection 2*e* which fits in the recess 4*h* (see FIG. 7). Furthermore, the pintle may be provided with a projection 4*i* while the pump housing 2 may be formed with a recess 2*f* which engages the projection 4*i* (see FIG. 8). As a further alternative, two bolts 6 of same size may be located at symmetrical positions, and a separate positioning pin 52 may be provided on the bolt 6 (see FIG. 9).

While the invention has been described above in terms of a preferred embodiment thereof, it should be understood that a number of changes, modifications and substitutions therein will readily occur to one skilled in the art from the above disclosure without departing from the spirit and scope of the invention defined by the appended claims.

What is claimed is:

1. A radial plunger pump, comprising a pump housing having a pintle receiving opening therein opening outwardly of the pump housing only at one side of the pump housing, means defining a suction passage and a discharge passage in the pump housing and communicating with the pintle receiving opening, a pintle received in said pintle receiving opening, said pintle being smaller in radial dimension than a radial dimension of said pintle receiving opening so that a gap exists therebetween, a rotor rotatably mounted on the pintle and in the gap, said rotor having a plurality of radially extending cylinder bores therein, a guide ring disposed around the rotor in eccentric relationship with the rotor, a plurality of plungers slidably fitted in the radially extending cylinder bores, said plungers each having an end projecting radially of the rotor and slidably engaging the guide ring, drive means for driving the rotor for rotation, said pintle including means thereon for engaging a wall surface of the pintle receiving opening, and fastening means for fixedly securing the pintle to the wall surface.

2. The radial plunger pump according to claim 1, wherein the pintle receiving opening in the pump housing includes a first portion of a reduced diameter which is located nearest a bottom of the pintle receiving opening and a second portion of an increased diameter which is located toward the open end of the pintle receiving opening, an end of the pintle being inserted into the first portion of the pintle receiving opening, said means on said pintle including a radially outwardly and circumferentially extending flange which is secured by said fastening means to the wall surface of the pintle receiving opening between the first and second portions thereof.

3. The radial plunger pump according to claim 1, wherein said fastening means comprises a plurality of bolts, and wherein the pintle is secured by the plurality of bolts oriented in a non-symmetrical manner.

4. The radial plunger pump according to claim 1, wherein said fastening means comprises a plurality of bolts, and wherein the pintle is secured by the plurality of bolts, said bolts being of different sizes.

5. The radial plunger pump according to claim 1, wherein said pintle includes means defining a discharge passage therein, and wherein a filter is disposed within the discharge passage.

6. The radial plunger pump according to claim 1, wherein the pump housing also includes a suction port having a stepped opening in which a filter having a frame formed of a resilient material is disposed, the frame having a flange engaging a step of the stepped opening, an annular projection on a surface of the flange and a connector for closing an opening on the pump housing to the suction port for maintaining liquid tightness of the pump housing, said annular projection directly abutting an inner surface of the connector.

7. The radial plunger pump according to claim 1, wherein said pump housing is a hollow cylinder open at one end and closed at an opposite end, and wherein said means on said pintle is secured by said fastening means to said wall surface which is defined by said closed opposite end.

8. A radial plunger pump, comprising a pump housing having a pintle receiving opening therein opening outwardly of the pump housing only at one side of the pump housing, means defining a suction passage and a discharge passage in the pump housing and communicating with the pintle receiving opening, a pintle received in said pintle receiving opening, said pintle being smaller in radial dimension than a radial dimension of said pintle receiving opening so that a gap exists therebetween, a rotor rotatably mounted on the pintle and in the gap, said rotor having a plurality of radially extending cylinder bores therein, a guide ring disposed around the rotor in eccentric relationship with the rotor, a plurality of plungers slidably fitted in the radially extending cylinder bores, said plungers each having an end projecting radially of the rotor and slidably engaging the guide ring, drive means for driving the rotor for rotation, said pintle including means thereon for engaging a wall surface of the pintle receiving opening, and fastening means for fixedly securing the pintle to the wall surface and further including means for positioning the pintle with respect to the pump housing.

9. The radial plunger pump according to claim 8, wherein the positioning means comprises a projection formed on one of the pintle and the pump housing and a recess formed on the other of the pintle and the housing for receiving the projection.

* * * * *